US005379517A

United States Patent [19]

Skelton

[11] Patent Number: 5,379,517

[45] Date of Patent: Jan. 10, 1995

[54] METHOD AND APPARATUS FOR ROOFING

[76] Inventor: Lawrence Skelton, 101 Harris La., Springdale, Ark. 72764

[21] Appl. No.: 747,841

[22] Filed: Nov. 9, 1990

Related U.S. Application Data

[60] Continuation of Ser. No. 362,474, Jun. 7, 1989, abandoned, which is a division of Ser. No. 918,476, Oct. 14, 1986, Pat. No. 4,872,331, which is a division of Ser. No. 669,471, Nov. 8, 1984, Pat. No. 4,686,809.

[51] Int. Cl.[6] ..... E04D 3/30

[52] U.S. Cl. ..... 29/897.3; 29/417; 52/478; 52/537; 52/545; 72/131; 72/181

[58] Field of Search ..... 29/897, 897.3, 897.32, 29/417, 243.5, 243.56, 243.58, 509, 819; 52/478, 520, 528, 529, 537, 542, 741, 748, 749, 545; 72/131, 176, 179, 181, 182

[56] References Cited

U.S. PATENT DOCUMENTS

| | | | |
|---|---|---|---|
| 451,550 | 5/1891 | Bayer | 52/528 |
| 2,294,324 | 8/1942 | Wilkens et al. | 72/181 X |
| 3,225,726 | 12/1965 | Tennison, Jr. | 29/417 X |
| 3,312,028 | 4/1967 | Schroyer | 29/897.32 X |
| 3,601,947 | 8/1971 | Hurd | 29/819 X |
| 3,694,829 | 10/1972 | Hale | 29/509 X |
| 3,875,642 | 4/1975 | Knudson | 29/243.5 X |
| 3,967,430 | 7/1976 | Knudson | 29/243.5 X |
| 4,027,611 | 6/1977 | Ward et al. | 29/243.5 |

FOREIGN PATENT DOCUMENTS

| | | | |
|---|---|---|---|
| 82/04002 | 11/1982 | WIPO | 29/243.5 |

*Primary Examiner*—Joseph M. Gorski
*Attorney, Agent, or Firm*—Boyd D. Cox

[57] ABSTRACT

A method and an appparatus for constructing a roof on a structure using elongated roofing members, as well as the elongated roofing members. Elongated roofing members are produced, preferably near or on the structure, by continuously forming suitable male and female flanges on sheet metal material and periodically cutting the sheet metal material to predetermined lengths. The male and female flanges of adjacent elongated roofing members are interconnected by deflecting a portion of the female flange about the male flange to crimp the male flange between portions of the female flange. A plurality of clips having flanges may be interconnected with the structure, whereby the flanges are engagable, together with the male flanges, with the female flanges to provide for rapid simultaneous interconnection of both the female flange and the male flange with the structure.

3 Claims, 3 Drawing Sheets

METHOD AND APPARATUS FOR ROOFING

This application is a continuation of U.S. application Ser. No. 07/362,474, filed Jun. 7, 1989, and now abandoned, which is a divisional of U.S. application Ser. No. 06/918,476, filed Oct. 14, 1986, and now U.S. Pat. No. 4,872,331, which in turn is a divisional of U.S. application Ser. No. 07/669,471, filed Nov. 8, 1984, and now U.S. Pat. No. 4,686,809.

BACKGROUND OF THE PRESENT INVENTION

The present invention relates to elongated roofing members, to a method and an apparatus for roofing using elongated roofing members to form a roof, and a roof formed by the method and apparatus. More particularly, the present invention relates to a method and an apparatus for on-site production of elongated roofing members and for interconnection of the elongated roofing members with a structure and with each other to form a roof.

Roofings constructed from elongated roofing members, particularly metallic elongated roofing members, have been popular for many years due to their durability, fire resistance, and energy conservation characteristics. Examples of roofings constructed from elongated roofing members are disclosed in U.S. Pat. No. 451,550, issued May 5, 1891, to Bayer; U.S. Pat. No. 4,224,775, issued Sep. 30, 1980, to Hecklesberg; U.S. Pat. No. 1,329,794, issued Feb. 3, 1920, to Moomaw, U.S. Pat. No. 4,296,581, issued Oct. 27, 1981, to Hecklesberg.

Previous elongated roofing members had various cross-sectional profiles to accomodate the interconnection of the sides of adjacent roofing members.

For example, in Bayer, an elongated trapezoidal form is provided adjacent each side of each elongated roofing member for interlocking with a similar elongated trapezoidal form on an adjacent elongated roofing member. Once a section of roof is assembled, the superimposed elongated trapezoidal forms are hammered such as to collapse them together against the structure to which the roof is mounted. The elongated roofing member of Bayer uses a substantial amount of overlap to provide a joint between adjacent elongated roofing members, thus requiring the use of a large amount of material to provide a roof. Furthermore, the joint is formed by a hammering operation which is expensive in its use of labor and machinery.

Moomaw uses interlocking elongated rounded beads to form a joint between adjacent elongated roofing members. To interlock one elongated roofing member of Moomaw with an adjacent roofing member requires some maneuvering of one of the elongated roofing members relative to the other in order to engage one of the elongated beads with the other. Thus, the elongated roofing members of Moomaw become increasingly difficult to use as the length of the elongated roofing members increases. Furthermore, as in Bayer, there is a substantial amount of material overlap in Moomow.

Hecklesberg '581 and Hecklesberg '775 each disclose elongated roofing members having elongated raised flanges along each of their edges. A first elongated roofing member is interconnected with a second elongated roofing member by disposing a first flange of the first elongated roofing member adjacent a second flange of the second elongated roofing member and pivoting the first elongated roofing member downwardly. The engaged flanges are subsequently interlocked by performing a sequence of bending operations on the flanges to compress them. As in Moomaw, the maneuvering required to engage adjacent elongated roofing members becomes increasingly difficult as the length of the elongated roofing members increases.

Unfortunately, none of the previous roofing methods provide for on-site production of the elongated roofing members. Instead, the roofing members are made at a remote location and must be transported to the site of the structure to which they are assembled to form a roof. Therefore, these roofing members are limited in length to such lengths as can be easily accommodated by a truck. Furthermore, the roofing members are produced in standard sizes, rather than to the proportions of the roof. Thus, in order to assemble a roof from existing elongated roofing members manufactured by existing methods and apparati, some of the elongated roofing members have to be cut to smaller sizes to fit the roof, resulting in a waste of material and labor. On the other hand, when the proportions of the roof exceed the length of the longest elongated roofing member available, it is necessary to use more than one elongated roofing member to cover a single length of roof. While various methods of interconnecting the ends of two elongated roof members are used, each requires a substantial amount of labor and material. Moveover, unless the two adjacent ends of the two elongated roofing members are joined together by one of the more expensive methods, such as welding, the joint is not as durable or as water tight as the elongated roofing members themselves, thus reducing the useful life of the roof or, at least, requiring periodic maintenance.

Even when the length of the elongated roofing members are optimal, the cost associated with transporting them is considerable due to their bulk, as compared, for example, with the bulk of a coil of sheet metal from which they are made. Furthermore, damage often occurs to a portion of the elongated roofing members as a result of the amount of handling required to load them on to a truck at the site of manufacture, unload them from the truck at the work site, raise them to the roof, and maneuver them into mutual engagement.

What is needed, therefore, is a more efficient method and apparatus for roofing constructed from a plurality of elongated roofing members, which avoids the disadvantages of the prior art described above. That is, what is needed is a method and an apparatus for the on-site manufacture of elongated roofing members of any preselected length and for interconnecting the elongated roofing members. Furthermore, what is needed are elongated roofing members having a cross-sectional profile that provides a minimal waste of material and a minimal overlap between adjacent elongated roofing members while providing for an inexpensive interconnection therebetween. Finally, what is needed are elongated roofing members having a cross-sectional profile which contributes to the rigidity of the roof constructed therefrom.

SUMMARY OF PRESENT INVENTION

The present invention provides a method and apparatus for roofing using elongated roofing members as well as providing elongated roofing members used in the method and the apparatus.

The method of the present invention includes the steps of continuously feeding a coil of flat sheet metal material to a roll forming apparatus, progressively feeding the flat sheet metal material between a plurality of pairs of rollers of the roll forming apparatus to form a male flange along one side of the flat sheet metal material and a female flange along another side of the flat sheet metal material, progressively feeding the flanges sheet metal material to a cutter, and periodically cutting the flanged sheet metal material into elongated roofing members of predetermined length. The elongated roofing members are disposed on a structure in an array and are interconnected with each other by selective deflection of a portion of the female flange of each elongated roofing member to surround a portion of the male flange of an adjacent elongated roofing member.

In the preferred embodiment, the method includes the step of interconnecting a plurality of straps or clips to the structure and disposing a portion of each of the clips between the portions of the female flange and the male flange which are to be interlocked such as to simultaneously interconnect the elongated roofing members with the structure when the elongated roofing members are interlocked with each other since each clip is fastened to the structure.

The apparatus of the present invention includes a roll forming apparatus having a plurality of pairs of rollers, a selectively operable cutter, and a moving apparatus for progressively feeding a coil of flat sheet metal material between the plurality of pairs of rollers and the selectively operable cutter. The plurality of pairs of rollers roll the flat sheet metal material into formed sheet metal material having a male flange along one side and a female flange along another side. The selectively operable cutter is selectively operated to periodically cut the formed sheet metal material into elongated roofing members of predetermined length.

In the preferred embodiment, the apparatus of the present invention also included an interconnection device for deflecting a portion of the female flange into locking engagement with the male flange.

A primary object of the present invention is to provide an inexpensive method and apparatus for the production of durable roofing.

Another object of the present invention is to provide a method and an apparatus for the production of elongated roofing members of any preselected length. In particular, it is an object of the present invention to provide a method and an apparatus for the production of roofing from extremely long elongated roofing members.

Yet another object of the present invention is to provide a method and an apparatus for the production of roofing having a minimal number of seams and requiring a minimal amount of labor as well as a minimal waste of material.

Still another object of the present invention is to provide a method and an apparatus for the production of a roof from elongated roofing members wherein the elongated roofing members may be interconnected with each other and with the structure requiring a roof in a single operation.

Still another object of the present invention is to provide for an inexpensive and durable roof from an inexpensive grade of steel by forming the steel into elongated roofing members having predetermined cross-sections to impart rigidity thereto.

Yet another object of the present invention is to provide a method and an apparatus for rapidly and inexpensively producing elongated roofing members of varying lengths.

Still yet another object of the present invention is to provide inexpensive and durable elongated roofing members which may be easily interconnected with each other to form a roof with a minimum amount of handling and a minimum amount of waste yet which provide a strong roofing structure when assembled.

These and may other objects, features, and advantages of the present invention will become apparant to those skilled in the art when the following detailed description of the preferred embodiments is read together with the drawings appended hereto.

BRIEF DESCRIPTION OF THE DRAWINGS

In the drawings appended hereto, wherein like reference numerals refer to like components throughout:

FIG. 1 is a perspective view of an example of a forming apparatus for forming elongated roofing members according to the present invention;

FIG. 3 is a sectional view taken along line 3—3 of FIG. 2 illustrating the first pair of forming rollers of the forming apparatus of FIG. 1;

FIG. 12 is a sectional view taken along line 12—12 of FIG. 3 illustrating a portion of an example of a bracket for supporting the various rollers of the forming apparatus.

DETAILED DESCRIPTION OF THE PREFERRED EMBODIMENTS

Figures 4, 5, 6, 7, 8, 9:
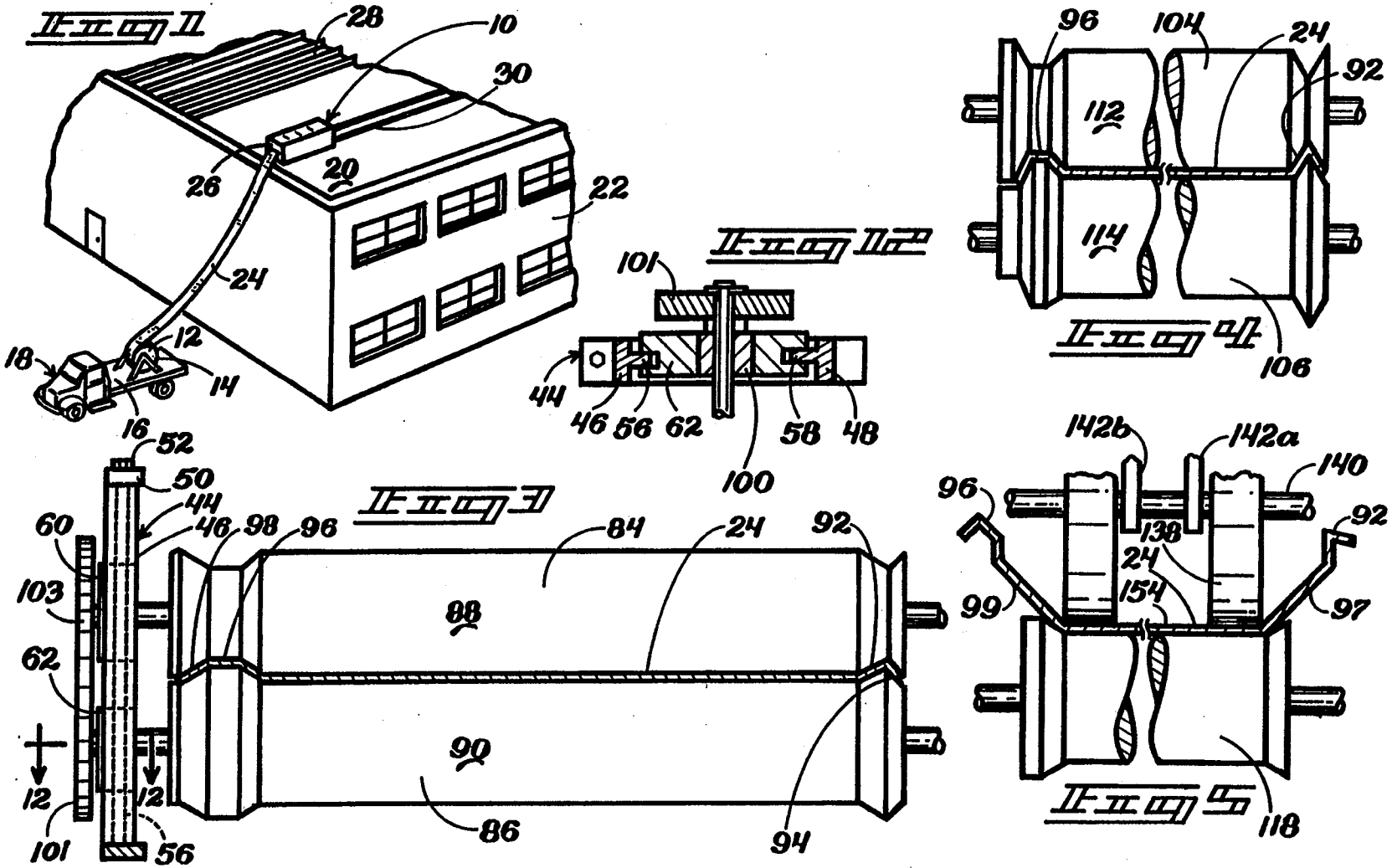
FIG. 4 is a sectional view taken along line 4—4 of FIG. 2 illustrating the second pair of forming rollers thereof.
FIG. 5 is a sectional view taken along line 5—5 of FIG. 2 illustrating the driving roller thereof.
FIG. 6 is a sectional view taken along line 6—6 of FIG. 2 illustrating the pinch rollers thereof.
FIG. 7 is a sectional view taken along line 7—7 of FIG. 2 illustrating the third pair of forming rollers thereof.
FIG. 8 is an end view of the forming apparatus of FIG. 2.
FIG. 9 is a perspective view of a structure having a plurality of elongated roofing members partially interconnected thereto according to the present invention.

Referring now to the drawing, and more particularly to FIG. 1 thereof, an example of a forming apparatus 10 according to the present invention is illustrated in use.

The forming apparatus 10 is supplied continuously with sheet metal material from a coil 12 of sheet metal material wound about a rotatable drum 14. In the example illustrated in FIG. 1, the rotatable drum 14 is mounted to the platform 16 of a truck 18 so as to facilitate use of the rotatable drum 14 in conjunction with the forming apparatus 10 for on-site production of elongated roofing members.

The sheet metal material may be of commercial grade steel (e.g. 36,000 psi). This is a lower grade of steel than may be used for prior roofing members and therefore results in a substantial costs savings. The lower grade may be used because the design of the panel imparts great strength to it and because the panel is handled less before and during installation, as will become apparent to those skilled in the art from the following detailed description.

In the example illustrated in the drawing, the forming apparatus 10 is rested on an existing roof 20 of a structure 22 requiring sheet metal roofing. A portion 24 of the sheet metal material extends upwardly from the rotatable drum 14 to the existing roof 20 and into the input end 26 of the forming apparatus 10. The sheet metal material is formed by the forming apparatus 10, in a manner to be described below, into elongated roofing members 28 which are fed progressively through the output end 30 of the forming apparatus 10.

It should be noted that the forming apparatus 10 may be disposed on the platform 16 of the truck 18 adjacent to the rotating drum during transit. However, the forming apparatus 10 is preferrably placed upon the existing roof 20 when in use so as to minimize the amount of handling required to position elongated roofing members 28 after they have been manufactured.

Figure 2:
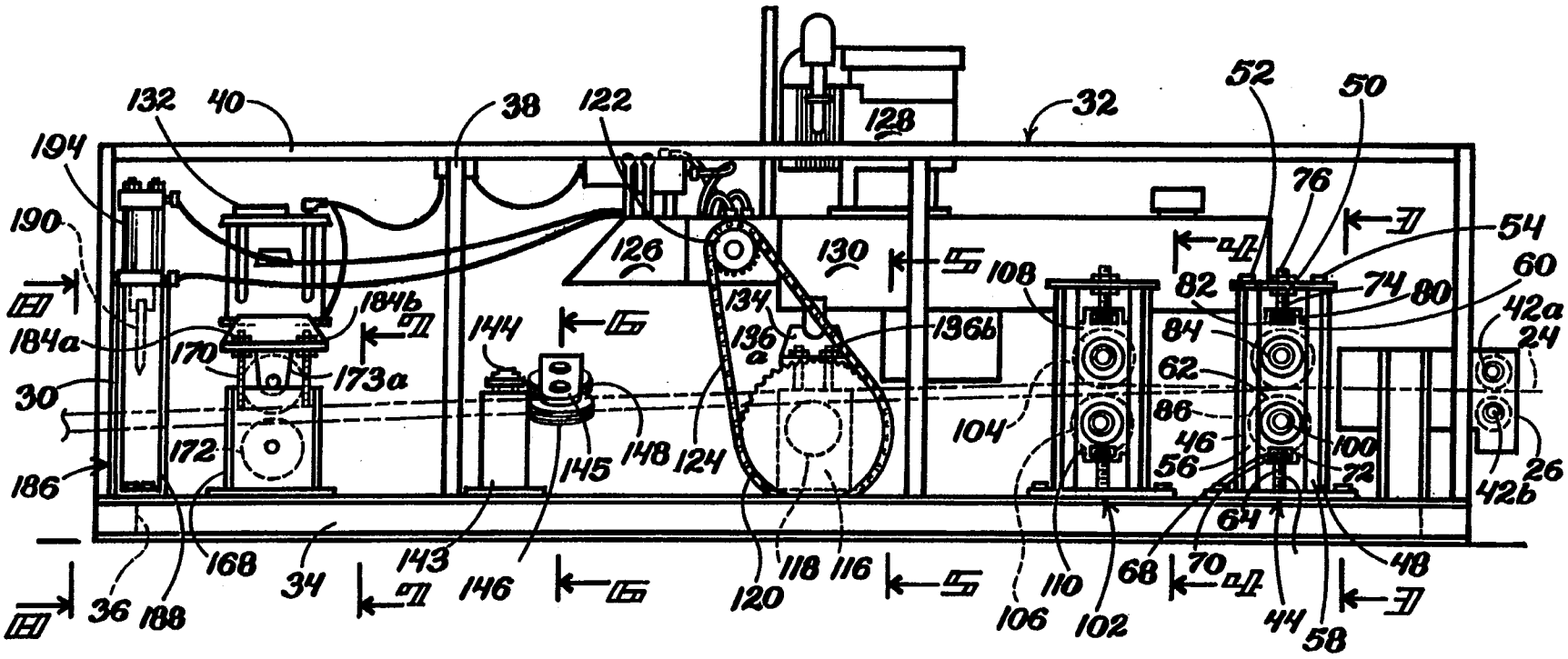
FIG. 2 is a schematic side view of the forming apparatus of FIG. 1.
Figure 6:
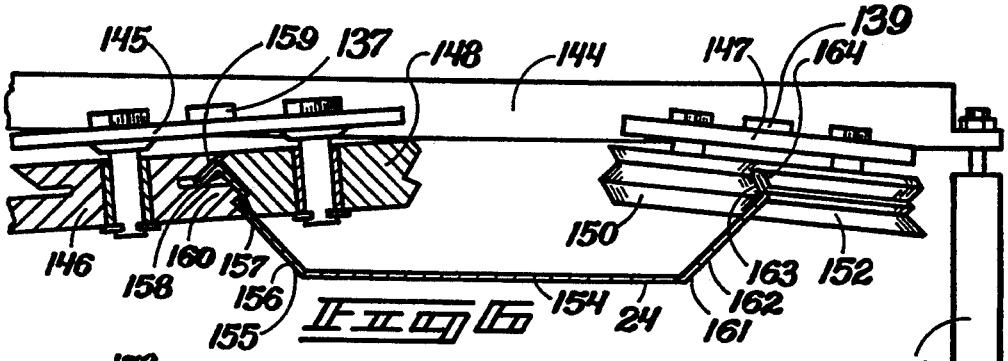
Figure 7:
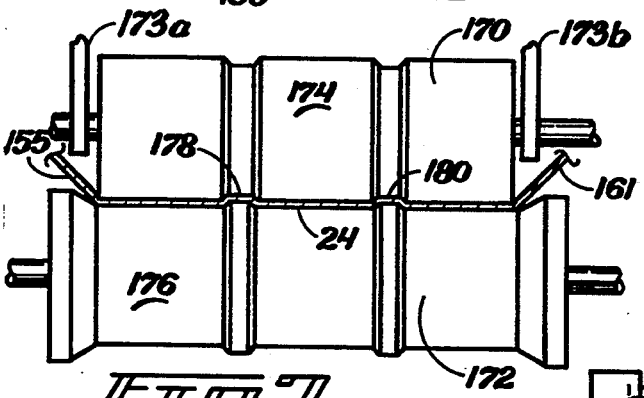
Figure 8:
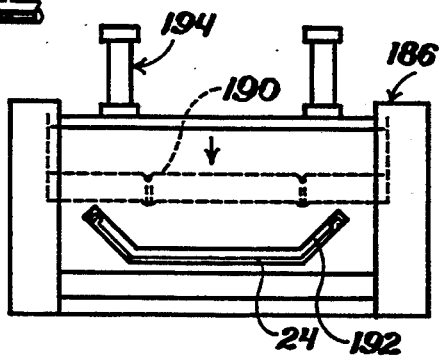

The details of the forming apparatus 10 are illustrated in the drawing in FIGS. 2 through 8 and in FIG. 12. As best shown in FIG. 2, the forming apparatus 10 is a roll forming machine having a light weight frame 32 constructed from a plurality of beams and posts. For example, as shown in FIG. 2, the frame 32 of the forming apparatus 10 may be constructed from a pair of spaced apart beams 34, only one of which is shown in FIG. 2, and from a plurality of crossbeams, such as crossbeam 36, extending horizontally therebetween. The frame 32 may be completed by a plurality of vertically disposed posts, such as post 38 each extending upwardly from one of the beams 34 and a plurality of horizontally disposed posts, such as horizontal post 40, interconnecting the upper ends of the vertically disposed posts. This beam and post construction for the frame 32 provides a strong yet lightweight structure that facilitates the lifting of the forming apparatus 10 to the existing roof 20.

As best shown in FIG. 2, the forming apparatus 10 includes a progressive series of mutually engaged pairs of rollers, each rotatably mounted to the frame 32. Each of the rollers progressively guides and shapes the portion 24 of sheet metal material supplied to the input end 26 of the forming apparatus into a predetermined cross sectional configuration. The various components of the forming apparatus 10 will be described below in progression from the input end 26 to the output end 30 thereof.

A first pair of guide rollers **42*a* and 42*b* are rotatably mounted in the input end 26 of the frame 32 of the forming apparatus 10. The guide rollers 42*a* and 42*b* cooperate with the portion 24 of sheet metal material to guide the sheet metal material into the forming apparatus 10**.

As shown partially in each of FIGS. 2, 3 and 12 a first pair of roller bracket assemblies 44 are provided adjacent the guide rollers 42, each being mounted to one of the beams 34. Since the roller bracket assemblies are identical, only one is illustrated and described herein.

As shown in FIGS. 2, 3 and 12 with respect to one roller bracket assembly 44, each of the roller bracket assemblies is provided with a pair of spaced apart, vertically disposed stanchions 46 and 48 extending upwardly from the beam 34 associated therewith. A cross member 50 extends between the upper ends of each pair of stanchions 46 and 48 and is removably interconnected therewith by means of bolts 52 and 54. A pair of opposed rails 56 and 58 are formed, respectively, on adjacent faces of the stanchions 46 and 48. An upper roller support element 60 and a lower roller support element 62 are movably disposed between each pair of rails 56 and 58 and engage the rails such as to be vertically positionable therealong.

A first screw member 64 is provided for the selective positioning of each of the lower roller support elements 62 relative to the frame 32 of the forming apparatus 10. Each first screw member 64 has a first end 66 abutting the beam 34 associated therewith and a second end 68 engaging the lower support element 62. Any appropriate means, such as a nut 70, movably disposed in an aperture 72 in the lower roller support element 62, may be provided for selective positioning of the lower roller support element 62 relative to the frame 32. Similarly, a second screw member 74 is provided for each of the roller bracket assemblies 44 for selective positioning of the upper roller support elements 60 relative to the lower roller support elements 62. Each of the second screw members 74 has a first end 76 threadedly engaging an intermediate portion of the cross member 50 and a second end 78 threadably engaging a nut 80 rotatably disposed in an aperture 82 in the upper rollersupport elements 60. The upper roller support elements 60 may therefore be selectively positioned a predetermined distance above the lower roller support elements 62 by operation of the nut 80.

As shown in FIGS. 2 and 3, a first pair of upper and lower forming rollers 84 and 86 are rotatably mounted between the roller bracket assemblies 44 such as to receive the portion 24 of sheet metal material from the guide rollers **42*a* and 42*b*. The upper forming roller 84 is rotatably mounted adjacent each of its respective ends of the upper roller support elements 60 and the lower forming roller 86 is rotatably mounted adjacent each of its respective ends to one of the lower roller support elements 62, as best shown in FIG. 3. Suitable bearing means, such as self-aligning bearings 100 are provided between the upper and lower forming rollers 84 and 86 and the upper and lower roller support elements 60 and 62**, respectively.

A pair of gears 101 and 103, shown only in FIGS. 3 and 12, may be mounted to one end, respectively, of the forming rollers 84 and 86 such as to facilitate the cooperative rotation of the forming rollers. The first pair of upper and lower forming rollers 84 and 86 are provided with predetermined mutually engageable forming surfaces 88 and 90, respectively, which cooperate with each other to form a first flange 92 extended angularly upward and then angularly downwardly along a first edge 94 of the sheet metal material and a second flange 96 extending angularly upwardly and then horizontally outwardly and then angularly downwardly along the second edge 98 of the sheet metal material.

As illustrated in FIG. 2 another pair of roller bracket assemblies 102 are mounted to the frame 32 of the forming assembly 10 adjacent the first pair of roller bracket assemblies 44. A second pair of upper and lower forming rollers 104 and 106 are rotatably mounted between respective pairs of adjustably positionable upper and lower roller support elements 108 and 110 of the roller bracket assemblies 102 in a manner similar to that described above relative to the first pair of upper and lower forming rollers 84 and 86.

The second pair of upper and lower forming rollers 104 and 106 are provided with predetermined mutually engageable forming surfaces 112 and 114, respectively, which cooperate with each other to receive the portion 24 of sheet metal material from the first pair of upper and lower forming rollers 84 and 86 and to further modify the sheet metal material such as to reform the first flange 92 and the second flange 96 by creating a more acute angular configuration thereof, as best shown in FIG. 4.

As illustrated in FIG. 2 a pair of driving roller supports 116 are mounted to the frame 32 of the forming assembly 10 adjacent the second pair of roller bracket assemblies 102 and downstream therefrom relative to the direction of feed of the portion 24 of sheet metal through the forming apparatus 10. A driving roller 118 is rotatably mounted between the driving roller supports 116 in a fixed position. A first sprocket member 120 is mounted to one end of the driving roller 118, the sprocket member 120 being interconnected, as shown in FIG. 2, with a second sprocket member 122 by means of chain 124.

Two second sprocket member 122 is rotatably driven by a hydraulic motor 126 mounted to the frame 32 of the forming apparatus 10 at a location above the driving roller 118. The hydraulic motor 126 is driven by appropriate means such as, for example, a pump and engine 128, shown mounted to the upper portions of the frame 32 and is interconnected, as well known in the art, with the pump and engine 128, a hydraulic tank 130, and the hydraulic motor 126. A battery 132 is further provided for an electric starter, not illustrated, of the pump and engine 128. It should be noted that the hydraulic motor 126, the pump and engine 128, and the hydraulic tank 130 may be mounted at various other locations on the forming apparatus 10.

A cross beam 134 is adjustably connected, for example by bolt **136*a* and 136*b*, with the uppermost end of each of the driving roller supports 116, as indicated in FIG. 2. A pair of idler rollers 138, best shown in FIG. 5, are rotatably mounted on an idler roller shaft 140 journalled on two idler roller flanges 142*a* and 142*b* extending downwardly from the crossbeam 134**.

The driving roller 118 and the idler rollers 138 receive therebetween the portion 24 of the sheet metal material from the second pair of upper and lower forming rollers 104 and 106. When the pump and engine 128 is operating, the pump pressurizes hydraulic fluid from the hydraulic tank 130 and uses the pressurized fluid to drive the hydraulic motor 126 which rotatably drives the driving roller 118 by way of the chain 124. The driving roller 118 is thereby rotatably driven to advance the portion 24 of sheet metal material through the forming apparatus 10. The driving roller 118 and the idler rollers 138 cooperate to form in the sheet metal material a third flange 97 extending angularly upwardly and outwardly from the flat central portion 154 of the portion 24 of the sheet metal material, such third flange 97 having the first flange 92 at the end thereof, and a fourth flange 99 extending angularly upwardly and outwardly from the flat central portion 154 of the portion 24 of the sheet metal material in a direction generally opposite to the third flange 97, such fourth flange 99 having the second flange 96 at the end thereof.

A pair of pinch roller stanchions 143 depicted partially in FIGS. 2 and 6, are mounted to the beams 34 of the frame 32 and extend upwardly therefrom. A beam 144 extends between the upper most portions of the pinch roller stanchions 143. As shown in FIG. 6, a first pair of pinch rollers 146 and 148 are mounted by means of a plate 145 to the beam 144 and a second pair of pinch rollers 150 and 152 are mounted by means of a plate 147 to the beam 144. The plates 145 and 147 are respectively connected to the beam 144 through struts 137 and 139, as shown in FIG. 6. The struts 137 and 139 have been omitted from FIG. 2, for clarity of illustration of the pinch rollers 146 and 148. The pinch rollers 146, 148, 150 and 152 perform the final forming operation on the first, second, third and fourth flanges 92, 96, 97 and 99.

The portion 24 of the sheet metal material leaving the driving roller 118 extends to the region between the pinch roller stanchions 143 with the second flange 96 directed between the first pair of pinch roller 146 and 148, and the first flange 92 directed between the second pair of pinch rollers 150 and 152, with the flat central portion 154 suspended freely therebetween.

The first pair of pinch rollers 146 and 148 cooperate to reshape the second and fourth flanges 96 and 99 into a female flange 155 having a first portion 156 extending angularly upwardly from the central portion 154 of the sheet metal and generally away therefrom. The female flange 155 has an offset second portion 157 for a purpose to be described shortly. The second portion 157 is preferably perpendicular to the first portion 156. The female flange 155 further has a third portion 158 extended outwardly from the second portion 157 in a direction away from the first portion. Finally, the female flange 155 has a fourth portion 159 extending angularly downwardly from the third portion 158 and in a direction generally away from the central portion thereof. The female flange 154 defines an elongated channel 160 for a purpose to be described shortly.

The second pair of pinch rollers 150 and 152 cooperate to reshape the first and third flanges 92 and 97 into a male flange 161 having a first portion 162 extending angularly upwardly from the central portion 154 of the sheet metal and generally away therefrom, and a second portion 163 extending angularly upwardly from the first portion 162 and in a general direction towards the female flange. A third portion 164 may be doubled over the second portion 163 to provide strength and to form a more reliable interconnection between the adjacent elongated roofing members 28 in a manner described shortly.

A pair of forming roller supports 168 are mounted to the frame adjacent the pinch roller stanchions 143, as shown in FIG. 2. A first forming roller 172 is rotatably mounted between the forming roller supports 168 in a fixed position. A crossbeam 182 is adjustably connected, for example by bolts **184*a* and 184*b*, with the uppermost end of each of the forming roller supports 168, as indicated in FIG. 2. A second forming roller 170, best shown in FIG. 7, is rotatably mounted on a forming roller shaft 171 journalled on two forming roller flanges 173*a* and 173*b* extending downwardly from the crossbeam 182. The forming rollers 170 and 172 receive the portion 24 of the sheet metal material from the pinch rollers 146, 148, 150 and 152 and reform, by means of mutually engagable forming surfaces 174 and 176, the flat central portion 154 of the sheet metal to provide two rectangular ribs 178 and 180 therealong to strengthen the elongated roofing members 28 produced by the forming apparatus 10**.

It should be noted that, in the preferred embodiment, as illustrated in FIG. 2, the crossbeam 182 provides a support for mounting the battery 132 described above.

A sheet metal cutter 186 is mounted to the output end 30 of the frame 32. The sheet metal cutter 186 is provided with an enclosure 188 surrounding and guiding a cutting blade 190. The enclosure is provided with a suitable passageway 192 for passage of the portion 24 of sheet metal material from the forming rollers 170 and 172. The passageway 192 has approximately the shape of the sheet metal so as to guide the sheet metal and further so as to position the sheet metal during a cutting operation. A hydraulic piston and cylinder assembly 194 is provided above the enclosure 188 and is interconnected hydraulically with the pump and engine 128 and mechanically with the cutter 186 in a known manner such as to be selectively operable to drive the cutting blade 190 across the passageway 192 to cut the elongated roofing member 28 produced by the forming apparatus 10 to any predetermined length.

The elongated roofing members 28 are preferably formed from 24" wide sheet steel. However, it is noted that the elongated roofing members are stretched during the formation process. For example, when 24" wide stock is used, the elongated roofing members 28 are approximately 4" high and cover approximately an 18" width of roof. Therefore, more roof coverage is achieved per unit of roofing material by utilizing the forming apparatus 10 of the instant invention than would otherwise be the case if the roofing members were simply bent to the desired configuration thereof.

It will be appreciated by those skilled in the art that the forming apparatus 10 described above is extremely portable and facilitates the manufacture of elongated roofing members 28 upon or near the structure requiring the roofing, thus minimizing the costs associated with transportation of materials as well as minimizing the handling of the elongated roofing members 28. Furthermore, the forming apparatus 10 described above permits the production of elongated roofing members 28 of any preselected length by the selective operation of the cutting blade 190, thus minimizing the waste of materials and labor associated with the use of elongated roofing members which are either too long or too short. Since the elongated roofing members produced by the forming apparatus are handled very little and are strong as a result of their cross-sectional profile, a less expensive grade of steel may be used, resulting in a substantial cost savings.

The elongated roofing members 28 produced by the forming apparatus 10 are easily interconnected with each other and with the structure 22 to form a durable roof, as will be described below in detail.

Figure 10:
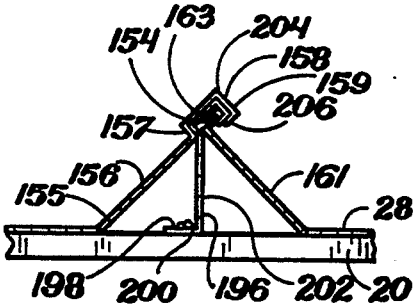
FIG. 10 is a front elevational view of a portion of the roof of FIG. 9 illustrating a pair of adjacent elongated members prior to interconnection with each other.
Figure 9:
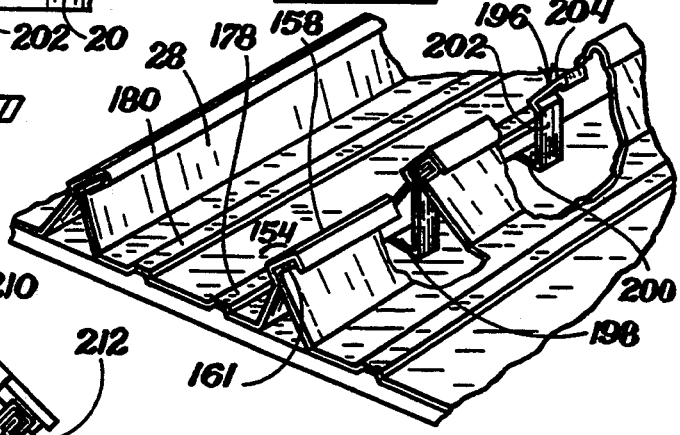
Figure 11:
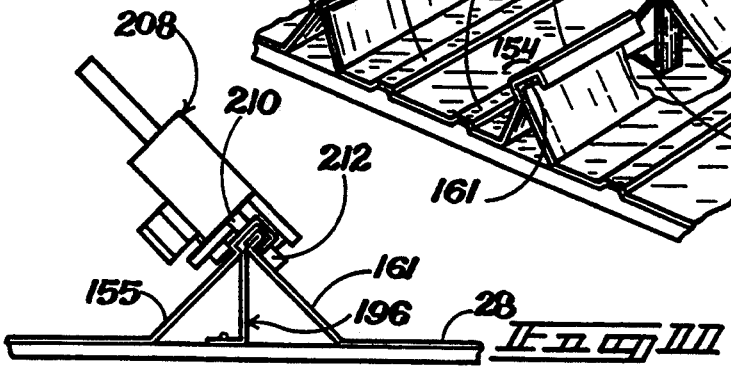
FIG. 11 is a front elevational view similar to FIG. 10 but illustrating an interlocking apparatus according to the present invention in the process of interconnecting the pair of adjacent elongated members with each other and with the structure.

The elongated roofing members 28 produced by the method of the present invention are preferably used in conjunction with straps or clips 196 which are mounted to the roof such as to reduce or eliminate the number of exposed fasteners. As shown in FIGS. 9 through 11, each of the clips 196 consists of a sheet metal member having a horizontal portion 198 and an elongated vertical portion 202 extending upwardly therefrom. A flange 204 extends angularly upward from the upper most end of the elongated vertical portion. The flange 204 may be flat or curved slightly to accomodate the clamping operations described below in detail. The straps 196 are preferably of pliable construction so that they will easily be bent into conformity with the other roofing elements, particularly with the female flange 155 of the elongated roofing member 28 (as shown in FIG. 10).

When an elongated roofing member is to be installed on the existing roof 20 using the clips 196, a plurality of the clips are first interconnected with the male flange 161 by bending a portion 206 of the flange 204 of each clip about the second and third portions 163 and 164 of the male flange, as shown in FIG. 10. The horizontal portion 198 of each clip is then fastened to the existing roof 20 by appropriate means, such as by fasteners 200. The clips 196 may be attache to the purlins, rafters, ceiling joists or any other appropriate part of the structure 22. Another elongated roofing member is placed on the existing roof 20 in a position such that its female flange 155 is disposed adjacent the clips 196. The flanges 204 of the clips 196 abut the third portion 158 of the female flange such that the flange 204 rests in the elongated channel 160.

It will be appreciated by those skilled in the art that the angle between the second and third portions 156 and 157 of the female flange 155 is preferred to be 90° so as to minimize the risk that any force applied to the situs of union of the female and male flanges would cause downward movement of the male flange 161, risking possible disengagement of the male and female flanges.

As shown in FIG. 10, the female flange 155 of the elongated roofing member 28 may be permanently interconnected with the male flange 161 of the elongated roofing member 28 by deflecting the fourth portion 159 of the female flange 155 about the male flange 161 such as to trap the second and third portions 163 and 164 of the male flange 161 as well as the flange 204 of the clips 196 between the third and fourth portions 158 and 159 of the female flange 155. This crimping operation may, for example, be performed by a crimping device 208 having a fixed anvil 210 engageable with the third portion 158 of the female flange 155 and a crimping member, such as roller 212, engageable with the fourth portion 159 thereof such as to progressively crimp the third and fourth portions 158 and 159 together.

It should be noted that the double thickness created by the second and third portions 163 and 164 contributes strength to the male flange 161 and provides for a tight union between the female flange 155, the male flange 161 and the clips 196.

It should also be noted that when the elongated roofing members 28 are assembled in the fashion just described that no apertures need be made in the elongated roofing members 28 to fasten them to the structure 22 thereby eliminating the risk of leakage through apertures of attachment.

It should further be noted that the elongated roofing members 28 of the presnt invention may be interconnected with each other in the manner described above without the use of clips 196, although a number of exposed fasteners will be required to properly hold the elongated roofing members 28 in position.

In the preferred embodiment, the first portions 156 and 162, respectively, of the female and male flanges 155 and 161 extend at a common predetermined angle relative to the central portion 154 of the elongated roofing member 28 of approximately one hundred thirty-five degrees while the second portion 157 of the female flange forms an angle of about ninety degrees relative to the first portion 156 of the female flange 155 and the third portion 158 of the female flange 155 forms an angle of about 90 degrees relative to such second portion 157 and the fourth portion 159 of the female flange 155 forms an angle of about 90 degrees relative to such third portion 158. Additionally, the second portion 163 of the male flange 161 forms an angle of about 90 degrees relative to the first portion 162 of the male flange 161 and the third portion 164 of the male flange 161 forms an angle of about 180 degrees relative to such second portion 163. These proportions provide for a reliable and easy alignment of adjacent elongated roofing members without an extensive amount of maneuvering of the elements and further provide a comparatively rigid roof assembly with a minimal overlap of material.

It will be readily apparent to those skilled in the art that the above described elongated roofing members are easy to assemble to each other and to a structure. They are extremely inexpensive to manufacture and require only a small amount of labor to be positioned and interconnected. Since few or no exposed fasteners are required, the roofing produced by assembling the elongated roofing members of the present invention will be long lived and comparatively maintenance free.

The shapes of the female and male flanges cooperate with each other and with the clips to provide a comparatively rigid roofing assembly.

The method of producing elongated roofing members according to the present invention reduces cost in a number of ways. The roofing members may be manufactured in an infinite variety of sizes to fit the site. The cost of transportation is lessened since the coil of sheet metal material is easier to transport than completed roofing members. The roofing members may be made of lesser grades of steel than was previously possible. Installation time is short since the roofing members are automatically supplied to the roof in the proper length and are rapidly interconnected to the roof and each other. Fewer total fasteners are used in the roofing assembly according to the present invention than in any comparable prior roofing assembly.

The above detailed description of the preferred embodiments of the present invention is offered by way of example and not by way of limitation and is representative of the best mode contemplated by the inventor at the time of filing the present application. Many modifications and variations may be made from the preferred embodiments without departing from the spirit of the present invention or the intended scope of the claims appended hereto.

What is claimed as novel is as follows:

1. A method of forming elongated roofing members for the construction of a roof, said method comprising the consecutive steps of:

(a) continuously feeding a supply of sheet metal material through a roll forming apparatus having a plurality of mutually engaged sets of forming rollers;

(b) continuously forming an elongated male flange extending from one edge of an elongated flat central portion of said sheet metal material, said elongated male flange having a first elongated portion extending angularly outwardly and upwardly from said elongated flat central portion of said sheet metal material and a second elongated portion extending angularly upwardly from said first elongated portion in the direction towards the area above said elongated flat central portion;

(c) continuously forming an elongated female flange extending from the opposite edge of said elongated flat central portion, said elongated female flange having a third elongated portion extending angularly outwardly and upwardly from said elongated flat central portion of said sheet metal material and a fourth elongated portion extending angularly upwardly from said third elongated portion generally in the direction toward the area above said elongated flat central portion, a fifth elongated portion extending angularly upwardly from said fourth elongated portion generally in the direction away from the area above said elongated flat central portion, and a sixth elongated portion extending angularly downwardly from said fifth elongated portion generally in the direction away from the area above said elongated flat central portion, said fourth, fifth and sixth elongated portions of said elongated female flange defining an elongated channel for receiving a second elongated portion of an elongated male flange of an adjacent elongated roofing member, said sixth elongated portion of said elongated female flange being deflectable such as to crimp the second elongated portion of the elongated male flange of the adjacent elongated roofing member between said fifth and sixth elongated portions of said elongated female flange to engage the elongated male flange of the adjacent elongated roofing member with said elongated female flange for interconnection of adjacent elongated roofing members;

(d) continuously feeding said sheet metal material from said plurality of mutually engaged sets of forming rollers to and through a selectively operable cutter; and (e) periodically actuating said selectively operable cutter so as to cut said sheet metal material into elongated roofing members of predetermined length, each of said elongated roofing members having an elongated central portion, and an elongated male flange and an elongated female flange extending upwardly from opposite edges thereof such that said elongated male flange of one of said elongated roofing members is selectively engageable with said elongated female flange of another of said elongated roofing members by deflection of a portion of said female flange about a portion of said male flange so as to crimp said female flange into engagement with said portion of said male flange.

2. The method of claim 1 further comprising before said continuously feeding step, the additional step of:

continuously supplying said supply of sheet metal material to said plurality of mutually engaged sets of forming rollers from a coil of sheet metal.

3. The method of claim 1 further comprising before said continuously feeding step, the additional step of:

forming at least one elongated ridge in said sheet metal material at a location intermediate said one edge and said other edge thereof, said at least one elongated ridge providing rigidity to said flat elongated portion of said elongated roofing member produced by said method.

* * * * *

UNITED STATES PATENT AND TRADEMARK OFFICE

CERTIFICATE OF CORRECTION

PATENT NO. : 5,379,517

DATED January 10, 1995

INVENTOR(S) : Lawrence Skelton

It is certified that error appears in the above-identified patent and that said Letters Patent is hereby corrected as shown below:

At column 3, line 4, "flanges" should read --flanged--.

At column 6, line 36, insert the words --to one-- following the word "ends".

Signed and Sealed this

Twenty-fifth Day of April, 1995

Bruce Lehman

BRUCE LEHMAN

*Commissioner of Patents and Trademarks*

*Attest:*

*Attesting Officer*